US007568884B2

(12) United States Patent
Fok

(10) Patent No.: US 7,568,884 B2
(45) Date of Patent: Aug. 4, 2009

(54) BLOWING MECHANISM FOR COLUMN TYPE ELECTRIC FAN

(76) Inventor: Su-Tim Fok, 6th Jihua Road, Foshan City, Guangdong Province (CN) 528000

( * ) Notice: Subject to any disclaimer, the term of this patent is extended or adjusted under 35 U.S.C. 154(b) by 522 days.

(21) Appl. No.: 11/520,280

(22) Filed: Sep. 12, 2006

(65) Prior Publication Data

US 2007/0065280 A1 Mar. 22, 2007

(30) Foreign Application Priority Data

Sep. 16, 2005 (CN) ..... 2005 2 0064782 U

(51) Int. Cl.
*F04D 29/44* (2006.01)

(52) U.S. Cl. ..... 415/125; 415/126; 415/127; 416/79; 416/112; 416/244 R

(58) Field of Classification Search ..... 415/53.1, 415/121.2, 125, 126, 127; 416/79, 82, 98, 416/112, 114, 244 R
See application file for complete search history.

(56) References Cited

U.S. PATENT DOCUMENTS 3,258,195 A * 6/1966 Laing ..... 415/53.3
5,266,004 A * 11/1993 Tsumurai et al. ..... 416/100
6,953,322 B2 * 10/2005 Lim ..... 416/100
6,997,680 B2 * 2/2006 Shapiro et al. ..... 416/100
7,217,098 B2 * 5/2007 Lim ..... 416/100

* cited by examiner

*Primary Examiner*—Igor Kershteyn
(74) *Attorney, Agent, or Firm*—Merchant & Gould P.C.

(57) ABSTRACT

A blowing mechanism for a column type electric fan comprises an impeller, a driving motor, a tube-like air ducting assembly, and a swing mechanism. The driving motor is mounted onto a supporting plate attached to the fan's housing. A micromotor of the swing mechanism is fixed onto a connecting disc-like part of the housing. The air ducting assembly comprises an inlet, an outlet, and a flow guiding plate and a flow deflecting plate connected between the top part and the bottom parts of the housing. An upper supporting shaft for the impeller is rotatably attached to the housing through a bearing, and a lower supporting shaft for the impeller is connected to an output shaft of the driving motor. The air ducting assembly is movably carried on the bearing rollers, the disposed on the supporting plate. A link rod of the swing mechanism is movably connected to a rocker extending from the air ducting assembly.

9 Claims, 3 Drawing Sheets

BLOWING MECHANISM FOR COLUMN TYPE ELECTRIC FAN

FIELD OF THE INVENTION

The present invention relates to a column type electric fan, and more particularly, to a blowing mechanism thereof.

BACKGROUND OF THE INVENTION

A known blowing mechanism for a column type electric fan essentially comprises an impeller, a driving motor, a tube-like air ducting assembly, a swing mechanism, etc. The air ducting assembly has an air inlet on one side and an outlet on the other side, and encloses the impeller from outside for collecting tangential air flow generated by the impeller and directing the air flow to the outside. A flow guiding plate and a flow deflecting plate are provided on the opposite sides of outlet. When the impeller rotates, air is sucked into the inlet of the air ducting assembly and is pressurized and discharged to the outside through the outlet. When it is desired for the electric fan to swingingly blow air, the swing mechanism is actuated, and the micromotor of which pushes the main body of the air ducting assembly to move via a crank rod, such that the air ducting assembly swings from side to side. There are two kinds of air ducting assemblies, one kind of air ducting assembly using the housing of the fan as the air ducting assembly, while the other kind of air ducting assembly being provided independently. Both the above-mentioned two kinds of air ducting assemblies are mounted together with the driving motor and the impeller onto the body of the electric fan. The main body of the air ducting assembly as well as the impeller and the driving motor are moved by the swing mechanism via the crank rod so as to swing from side to side. As a result, the swing mechanism operates under high load, and thus the micromotor, the crank, the rod and so on are likely to be worn out. At the same time, some problems such as vibrating and operation noise are easily to be generated. Moreover, as the driving motor swings along with the air ducting assembly, the power cable contacts with and is scrubbed by neighbor components, resulting in the insulating layer of the power cable worn quickly and even causing electric short circuit, which creates a potential safety trouble. People have tried to solve this technical problem for this type of fan products in recent 20 years. Generally, lengthening the wire and thickening the insulating layer have been employed. These techniques result in waste of materials. Meanwhile, the power cable with thicker insulating layer generates a greater resistance against the swing mechanism, which likely leads to abnormal operations such as uneven swing, etc.

SUMMARY OF THE INVENTION

An object of the invention is to overcome the above-mentioned disadvantages by providing a blowing mechanism for a column type electric fan, which can reduce the load of the swing mechanism, avoid the wear of the power cable, and run stably and safely with a low noise and a longer service life.

To this end, the present invention provides a blowing mechanism for a column type electric fan, which comprises an impeller, a driving motor, a tube-like air ducting assembly, and a swing mechanism. The driving motor is mounted onto a supporting plate which is attached to a housing of the fan. A micromotor of the swing mechanism is fixed onto a connecting disc-like part of the housing. The air ducting assembly at least partly encloses the impeller from outside. The air ducting assembly comprises a top part, a bottom part and a flow guiding plate and a flow deflecting plate connected between the top part and the bottom part, and is provided with an air inlet and an air outlet. An upper supporting shaft for the impeller is rotatably attached to the housing through a bearing, and a lower supporting shaft for the impeller is connected to an output shaft of the driving motor. A guiding lattice is arranged at the air outlet of the air ducting assembly. Bearing rollers are disposed on the supporting plate. The air ducting assembly is movably carried on the bearing rollers. The air ducting assembly is equipped with retainers for preventing the air ducting assembly from moving beyond desired limit angular positions during its swing motion. A link rod of the swing mechanism is movably connected to a rocker which extends from the air ducting assembly. When the blowing mechanism operates, the impeller rotates to suck air into the air ducting assembly through the air inlet thereof from inlet openings formed in the housing. The air in the air ducting assembly is pressurized by the impeller, and then is directed to the guiding lattice of the air ducting assembly by means of the flow guiding plate and the flow deflecting plate. Then, the air is forced to move through the air outlet and is blown out of the fan through outlet openings formed in the housing. When it needs to blow out air in a swing way, the rocker of the air ducting assembly is pushed to move by the micromotor of the swing mechanism via a crank and the link rod, such that the air ducting assembly swings from side to side in a horizontal direction and thus the desired swinging operation is achieved.

The invention has the following advantages compared with the prior art.

First, only the air ducting assembly is pushed to swing to and fro by the swing mechanism of the column type electric fan, while other components such as the driving motor, the impeller, the power cable, etc., are attached to the housing and do not swing with the air ducting assembly. Therefore, the load of the swing mechanism as well as the noise and the vibration caused by the swing movement would be reduced significantly, which leads to a stable operation. At the same time, the possibility of electric short circuit caused by the wear or breakage of the power cable scrubbed by the swing mechanism is eliminated. Thus the technical difficulty existed in the prior art is addressed.

Second, when the column type electric fan operates for blowing while swinging, the swing mechanism thereof is only subject to a load generated by the air ducting assembly. Since the weight of the air ducting assembly is only 10% of that of the body of the fan, malfunctions caused by the breakage due to the overload applied to the components of the actuation mechanism such as the micromotor and the crank can be decreased, and the service life of the product is prolonged effectively.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENT

Figure 1:
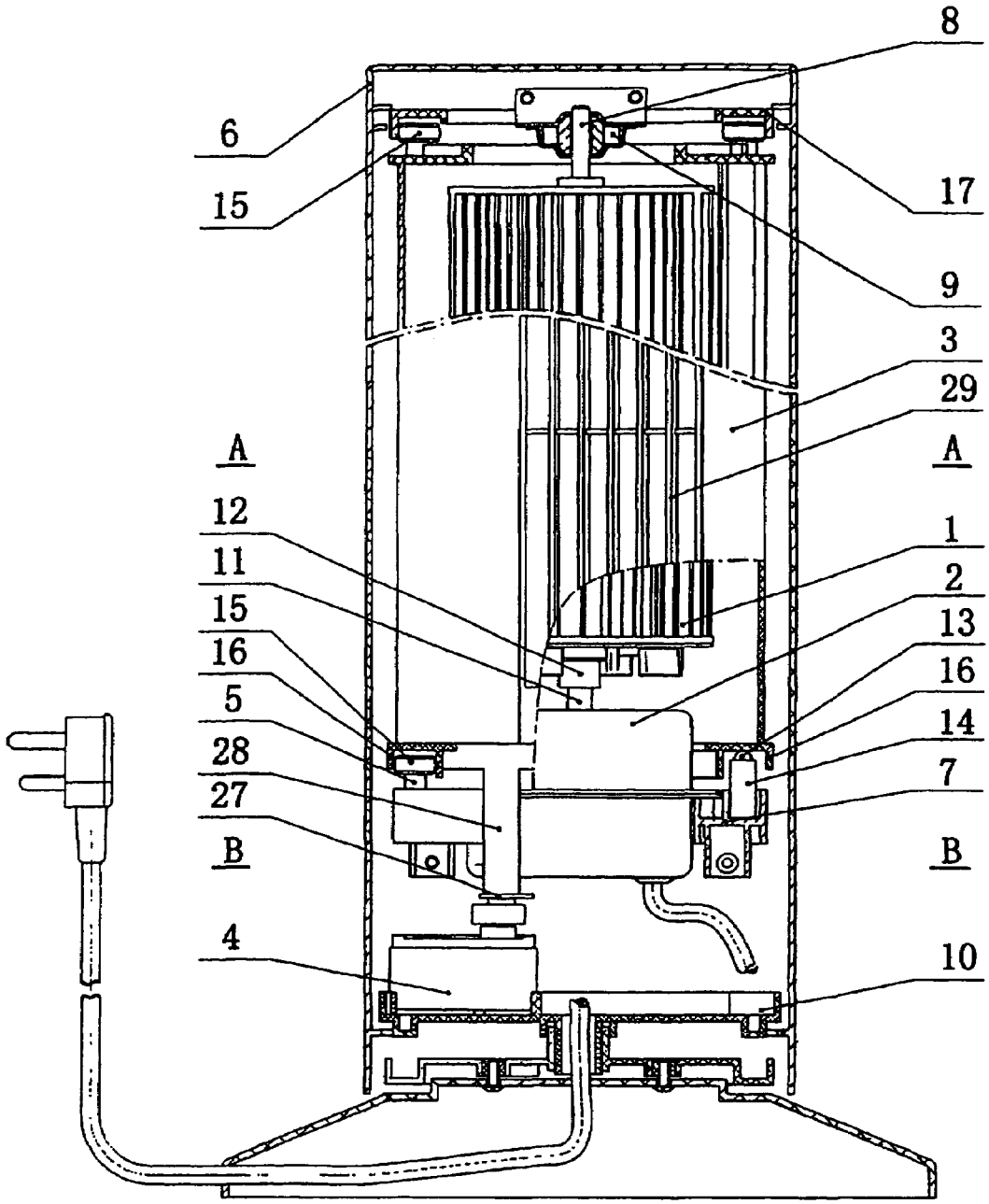
FIG. 1 is a schematic view showing the structure of the present invention.
Figure 2:
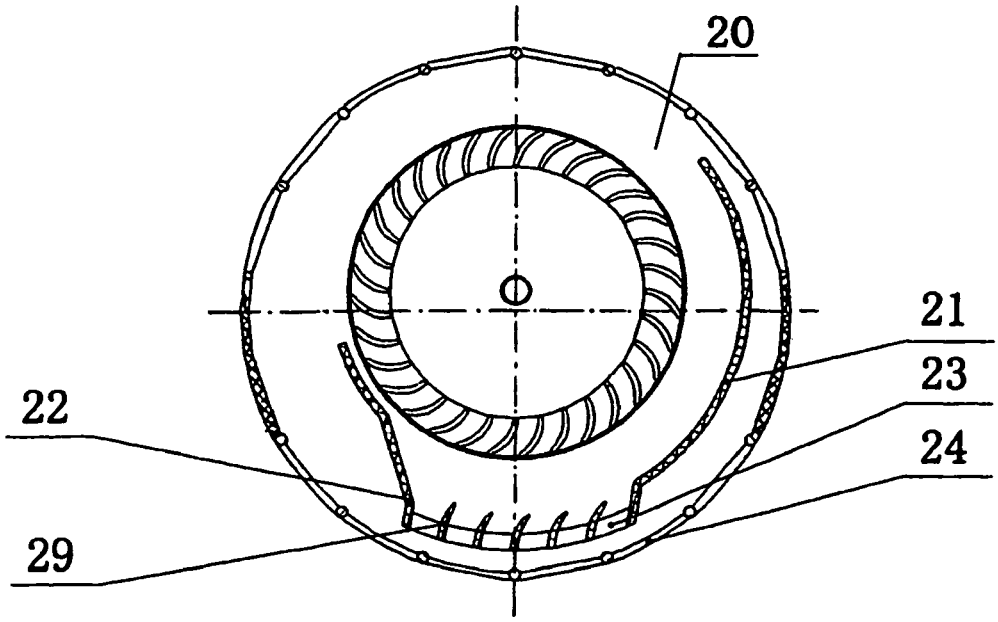
FIG. 2 is a schematic sectional view taken along line A-A of FIG. 1.
Figure 3:
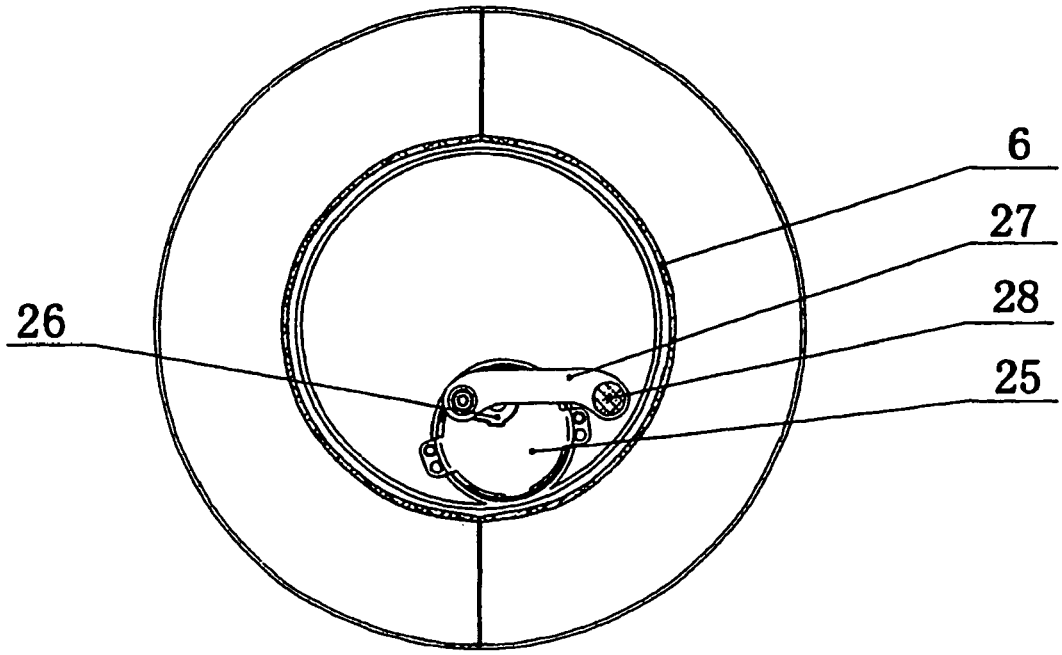
FIG. 3 is a schematic sectional view along line B-B of FIG. 1.
Figure 4:
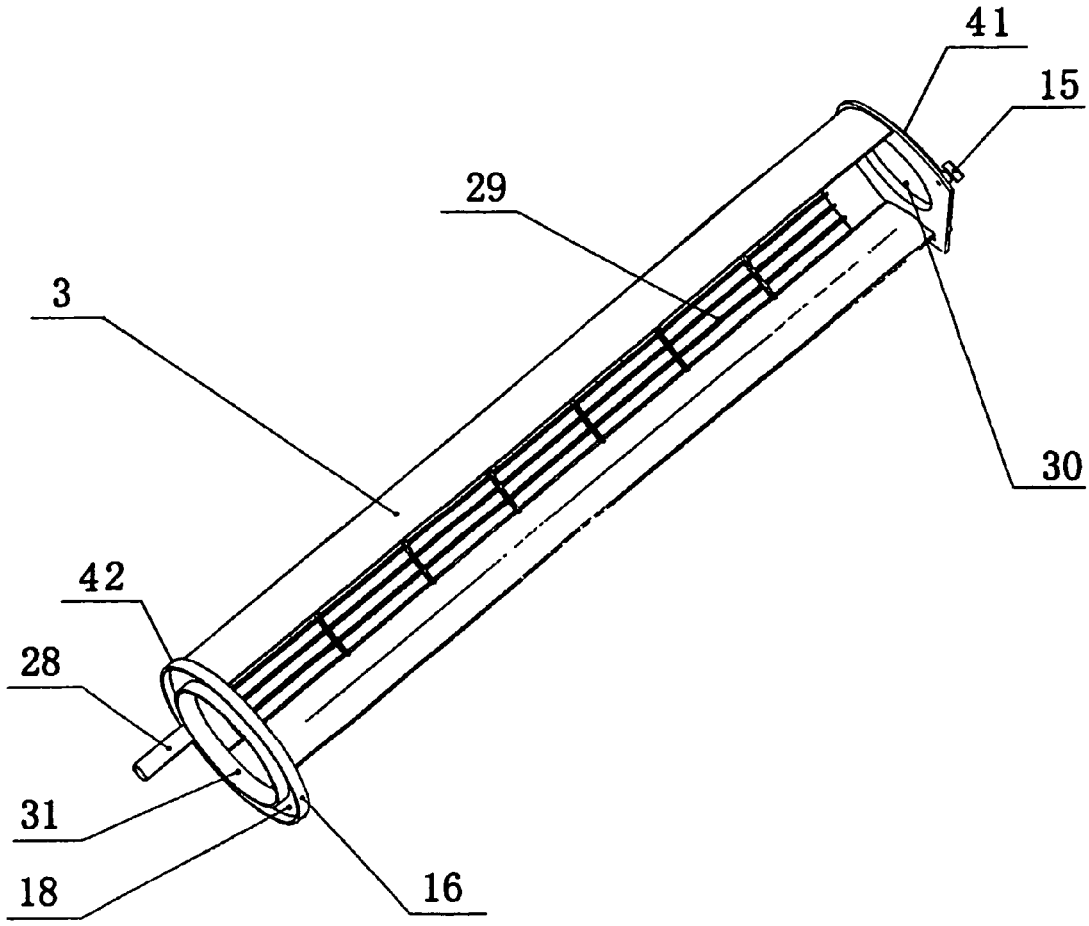
FIG. 4 is a schematic view showing the structure of the air ducting assembly of the present invention.

Referring to the drawings, a blowing mechanism for a column type electric fan, according to the present invention, comprises an impeller 1, a driving motor 2, a tube-like air ducting assembly 3 and a swing mechanism 4. The driving motor 2 is mounted onto a supporting plate 7 which is attached to a housing 6 of the fan. A micromotor 25 of the swing mechanism 4 is fixed onto a connecting disc-like part 10 of the housing 6. A link rod 27 of the swing mechanism is movably connected to a rocker 28 which extends from the lower end of the air ducting assembly 3. The air ducting assembly 3 at least partly encloses the impeller 1 from outside, and an upper supporting shaft 8 of the impeller is rotatably attached to the housing 6 through a bearing 9, while a lower supporting shaft 12 of the impeller is connected to an output shaft 11 of the driving motor. The air ducting assembly 3 comprises a top part 41, a bottom part 42 and a flow guiding plate 21 and a flow deflecting plate 22 connected between the top part and the bottom part, and is provided with an air inlet 20 and an air outlet 23. A guiding lattice 29 having flow deflecting blades is arranged at the air outlet 23 of the air ducting assembly 3. Bearing rollers 13 for bearing the air ducting assembly 3 are disposed on the supporting plate 7. An annular recess 18 is formed into the bottom part of the air ducting assembly 3 for receiving and sliding on the bearing rollers 13. The number of the bearing rollers 13 is preferably at least three. The bearing rollers 13 in an embodiment are steel balls each being carried on the supporting plate 7 by a carrier 14. The top part and the bottom part of the air ducting assembly 3 are formed with through openings 30 and 31 respectively, for providing space to be inserted through by the upper supporting shaft and the driving motor. The air ducting assembly 3 is equipped with retainers 15 for preventing the air ducting assembly from moving beyond desired limit angular positions during its swing motion. Preferably, an upper retainer 15 is arranged on the top part of the air ducting assembly 3 and a lower retainer 15 is arranged on the top of the supporting plate 7. A track 16 for the lower retainer 15 is arranged on the underside of the bottom part of the air ducting assembly 3, while another track 17 for the upper retainer 15 is arranged near the inner wall of the top of the housing 6. In the embodiment shown in the figures, the track 16 is provided by the annular recess 18. The retainers 15 in an embodiment are wheel rollers, which are mounted on the top part of the air ducting assembly 3 and the support plate 7 via roller shafts 5 respectively.

When the blowing mechanism operates, the impeller 1 rotates to suck air into the air ducting assembly 3 through the air inlet 20 thereof from inlet openings 19 formed in the housing 6. The air in the air ducting assembly 3 is pressurized by the impeller 1 and then is directed to the guiding lattice 29 of the air ducting assembly 3 by the flow guiding plate 21 and the flow deflecting plate 22. Afterwards, the air is forced through the air outlet 23 and blown out of the fan through outlet openings 24 formed in the housing 6. When it needs to blow out air in a swing way, the rocker 28 of the air ducting assembly 3 is pushed to move by the micromotor 25 of the swing mechanism 4 via a crank 26 and the link rod 27, such that the air ducting assembly 3 swings from side to side in a horizontal direction and thus the desired swinging operation is achieved.

While the present invention has been described in connection with the preferred embodiments with reference to the accompanying drawings, it should be understood by those skilled in the art that it is only an illustration rather than a limitation. Various modifications and changes could be made without departing from the spirit and scope of the invention defined by the accompanying claims together with their modifications and variations as well as the equivalents thereof.

What is claimed is:

1. A blowing mechanism for a column type electric fan, comprising an impeller, a driving motor, a tube-like air ducting assembly, and a swing mechanism, wherein the driving motor is mounted onto a supporting plate attached to the fan, a micromotor of the swing mechanism is fixed onto a connecting disc-like part of the housing, the air ducting assembly at least partly encloses the impeller from outside, the air ducting assembly comprises a top part, a bottom part and a flow guiding plate and a flow deflecting plate connected between the top part and the bottom part, and is provided with an air inlet and an air outlet, an upper supporting shaft for the impeller is rotatably attached to the housing through a bearing, and a lower supporting shaft for the impeller is connected to an output shaft of the driving motor, characterized in that, guiding lattice is arranged at the air outlet of the air ducting assembly, bearing rollers are disposed on the supporting plate, the air ducting assembly is movably carried on the bearing rollers, the air ducting assembly is equipped with retainers for preventing the air ducting assembly from moving beyond desired limit angular positions during its swing motion, and a link rod of the swing mechanism is movably connected to a rocker which extends from the air ducting assembly.

2. The blowing mechanism according to claim 1, wherein an annular recess is formed into the bottom part of the air ducting assembly.

3. The blowing mechanism according to claim 1, wherein the retainers comprises an upper retainer arranged on the top part of the air ducting assembly and a lower retainer arranged on the top of the supporting plate.

4. The blowing mechanism according to claim 3, wherein a track for the lower retainer is arranged on the underside of the bottom part of the air ducting assembly.

5. The blowing mechanism according to claim 3, wherein another track for the upper retainer is arranged near the inner wall of the top of the housing.

6. The blowing mechanism according to claim 1, wherein the retainers are wheel rollers.

7. The blowing mechanism according to claim 1, wherein the number of the bearing rollers is at least three.

8. The blowing mechanism according to claim 1, wherein the bearing rollers are steel balls.

9. The blowing mechanism according to claim 1, wherein the rocker extends from the lower end of the air ducting assembly.

* * * * *